US006769974B2

(12) United States Patent
Wang

(10) Patent No.: US 6,769,974 B2
(45) Date of Patent: Aug. 3, 2004

(54) SAND-BELT FINISHING MACHINE HAVING A SAND-BELT REPLACEMENT MECHANISM

(76) Inventor: Wang Tien Wang, No. 45, Yi Chang East Rd., Taiping, Taichung Hsien (TW), 411

( * ) Notice: Subject to any disclaimer, the term of this patent is extended or adjusted under 35 U.S.C. 154(b) by 0 days.

(21) Appl. No.: 10/285,535

(22) Filed: Nov. 1, 2002

(65) Prior Publication Data

US 2004/0087261 A1 May 6, 2004

(51) Int. Cl.[7] ..... B24B 21/00

(52) U.S. Cl. ..... 451/311; 451/296; 451/303; 451/355; 451/513

(58) Field of Search ..... 451/296–311, 355, 451/513; 474/101, 109, 115, 150, 117, 125

(56) References Cited

U.S. PATENT DOCUMENTS

| | | | | | |
|---|---|---|---|---|---|
| 1,108,176 | A | * | 8/1914 | Hormel | 451/297 |
| 1,956,556 | A | * | 5/1934 | Bazzoni | 451/296 |
| 2,463,287 | A | * | 3/1949 | Krueger | 451/297 |
| 2,562,229 | A | * | 7/1951 | Bell | 451/303 |
| 2,724,934 | A | * | 11/1955 | Urquhart | 451/310 |
| 3,611,646 | A | * | 10/1971 | Cameron et al. | 451/355 |
| 3,643,385 | A | * | 2/1972 | Mikiya | 451/355 |
| 4,115,957 | A | * | 9/1978 | Porth et al. | 451/355 |
| 4,509,296 | A | * | 4/1985 | Rasmussen | 451/297 |
| 4,535,568 | A | * | 8/1985 | LaFave | 451/311 |
| 4,939,870 | A | * | 7/1990 | Wang | 451/296 |
| 4,977,708 | A | * | 12/1990 | Kloft | 451/359 |
| 5,165,203 | A | * | 11/1992 | Chuang | 451/297 |
| 5,185,962 | A | * | 2/1993 | Liou | 451/311 |
| 5,830,046 | A | * | 11/1998 | Dugger et al. | 451/297 |
| 5,864,746 | A | * | 1/1999 | Chang | 451/296 |
| 6,030,305 | A | * | 2/2000 | Hood | 474/109 |
| 6,135,866 | A | * | 10/2000 | Wang | 451/296 |
| 6,283,841 | B1 | * | 9/2001 | Wang | 451/296 |
| 6,398,681 | B1 | * | 6/2002 | Wanie | 474/101 |
| 6,537,142 | B2 | * | 3/2003 | Liou | 451/311 |

* cited by examiner

*Primary Examiner*—George Nguyen
(74) *Attorney, Agent, or Firm*—Rosenberg, Klein & Lee

(57) ABSTRACT

A sand-belt finishing machine having a sand-belt replacement mechanism includes a support rack, a first roller, a second roller, an upright rod, an elastic member, a sand belt, and a pull lever. When the upright rod is moved by the pull lever to compress the elastic member, the distance between the first roller and the second roller is shortened. When the upright rod is released by the pull lever, the upright rod is returned to its original position by the elastic member, so that the distance between the first roller and the second roller is increased. Thus, the sand belt can be mounted on and detached from the first roller and the second roller rapidly, easily and conveniently, thereby facilitating the user replacing the sand belt.

4 Claims, 5 Drawing Sheets

SAND-BELT FINISHING MACHINE HAVING A SAND-BELT REPLACEMENT MECHANISM

BACKGROUND OF THE INVENTION

1. Field of the Invention

The present invention relates to a sand-belt finishing machine having a sand-belt replacement mechanism, and more particularly to a sand-belt finishing machine having a sand-belt replacement mechanism, wherein the sand belt can be assembled and disassembled rapidly, easily and conveniently, thereby facilitating the user replacing the sand belt.

2. Description of the Related Art

The sand-belt finishing machine is a working machine that is used to finish the surface of the wooden material. As shown in FIG. 1, a conventional sand-belt finishing machine (not shown) in accordance with the prior art comprises a transverse roller 11, and a sand belt 12 wound around the surface of the roller 11. When in use, the wooden material is passed through the lower side of the roller 11 which is being rotated, so that the wooden material is rubbed and finished by the sand belt 12 on the surface of the roller 11, thereby achieving a finishing effect. However, when the sand belt 12 needs to be replaced, the user has to remove the worn sand belt 12 from the roller 11, and has to wind a new sand belt 12 around the roller 11, thereby consuming much time, and thereby causing inconvenience to the user.

SUMMARY OF THE INVENTION

The present invention has arisen to mitigate and/or obviate the disadvantage of the conventional sand-belt finishing machine.

The primary objective of the present invention is to provide a sand-belt finishing machine having a sand-belt replacement mechanism, wherein the sand belt can be assembled and disassembled rapidly, easily and conveniently, thereby facilitating the user replacing the sand belt.

Another objective of the present invention is to provide a sand-belt finishing machine having a sand-belt replacement mechanism, wherein the sand belt can be assembled and disassembled rapidly, easily and conveniently, thereby saving the working time.

In accordance with the present invention, there is provided a sand-belt finishing machine having a sand-belt replacement mechanism, comprising:

a support rack;

a first roller mounted on the support rack;

a second roller located in parallel with the first roller, and spaced from the first roller with a determined distance;

an upright rod secured on a bottom face of the support rack;

an elastic member mounted on the upright rod;

a sand belt mounted on the first roller and the second roller; and a pull lever connected to the upright rod to drive the upright rod to move; wherein:

when the upright rod is moved by the pull lever to compress the elastic member, the distance between the first roller and the second roller is shortened; and when the upright rod is released by the pull lever, the upright rod is returned to its original position by the restoring force of the elastic member, so that the distance between the first roller and the second roller is increased.

Further benefits and advantages of the present invention will become apparent after a careful reading of the detailed description with appropriate reference to the accompanying drawings.

DETAILED DESCRIPTION OF THE INVENTION

Figure 1:
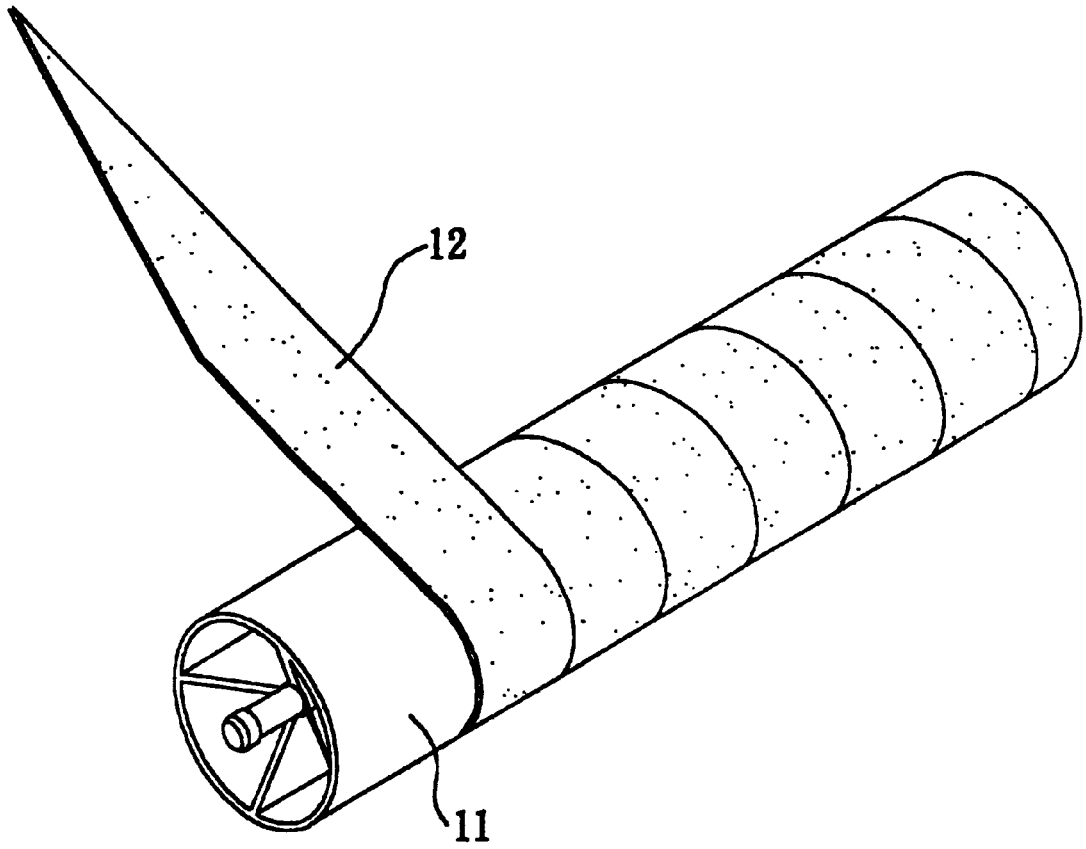
FIG. 1 PRIOR ART
FIG. 1 is a partially perspective view of a conventional sand-belt finishing machine in accordance with the prior art.
Figure 2:
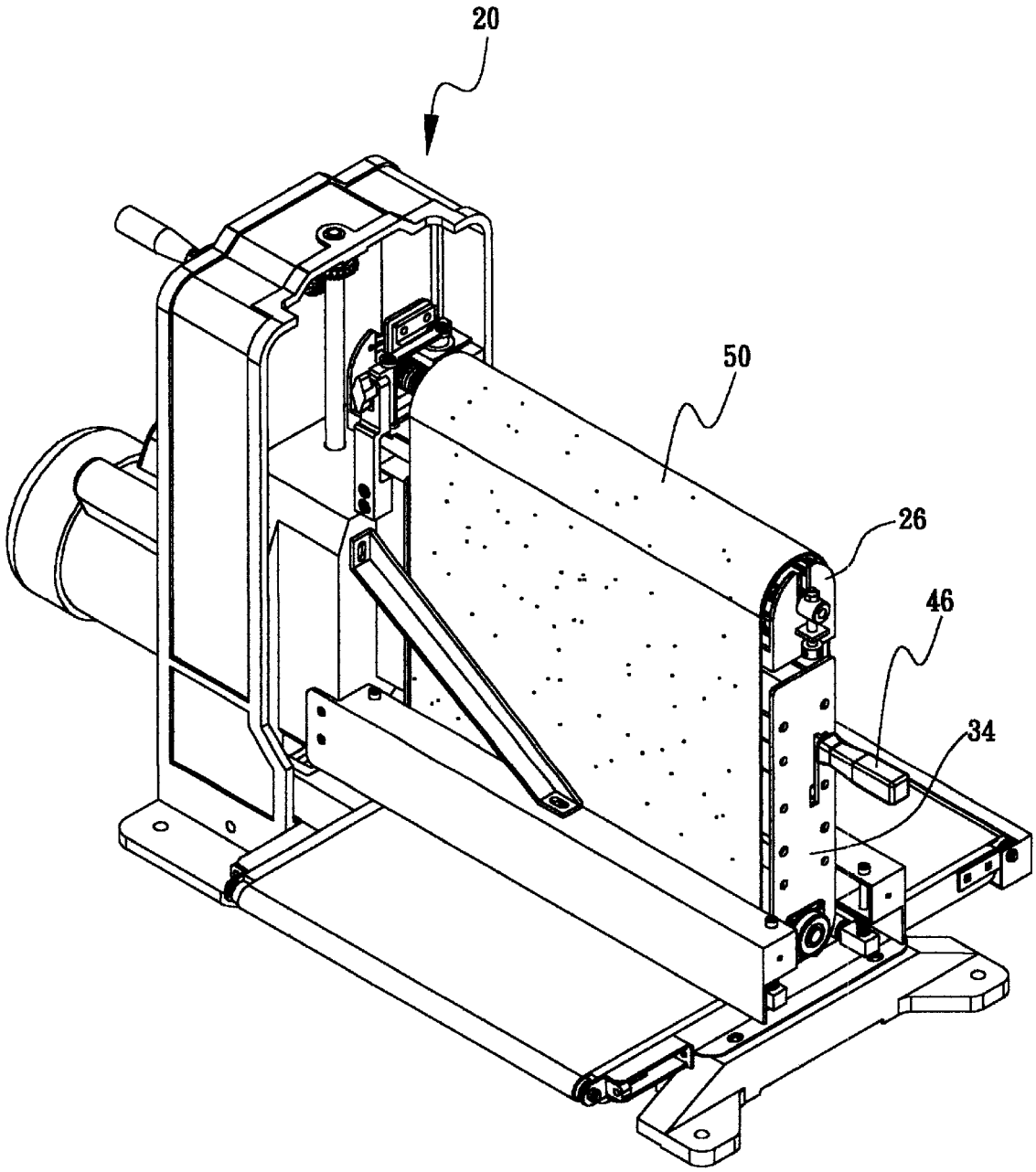
FIG. 2 is a perspective view of a sand-belt finishing machine having a sand-belt replacement mechanism in accordance with a preferred embodiment of the present invention.
Figure 3:
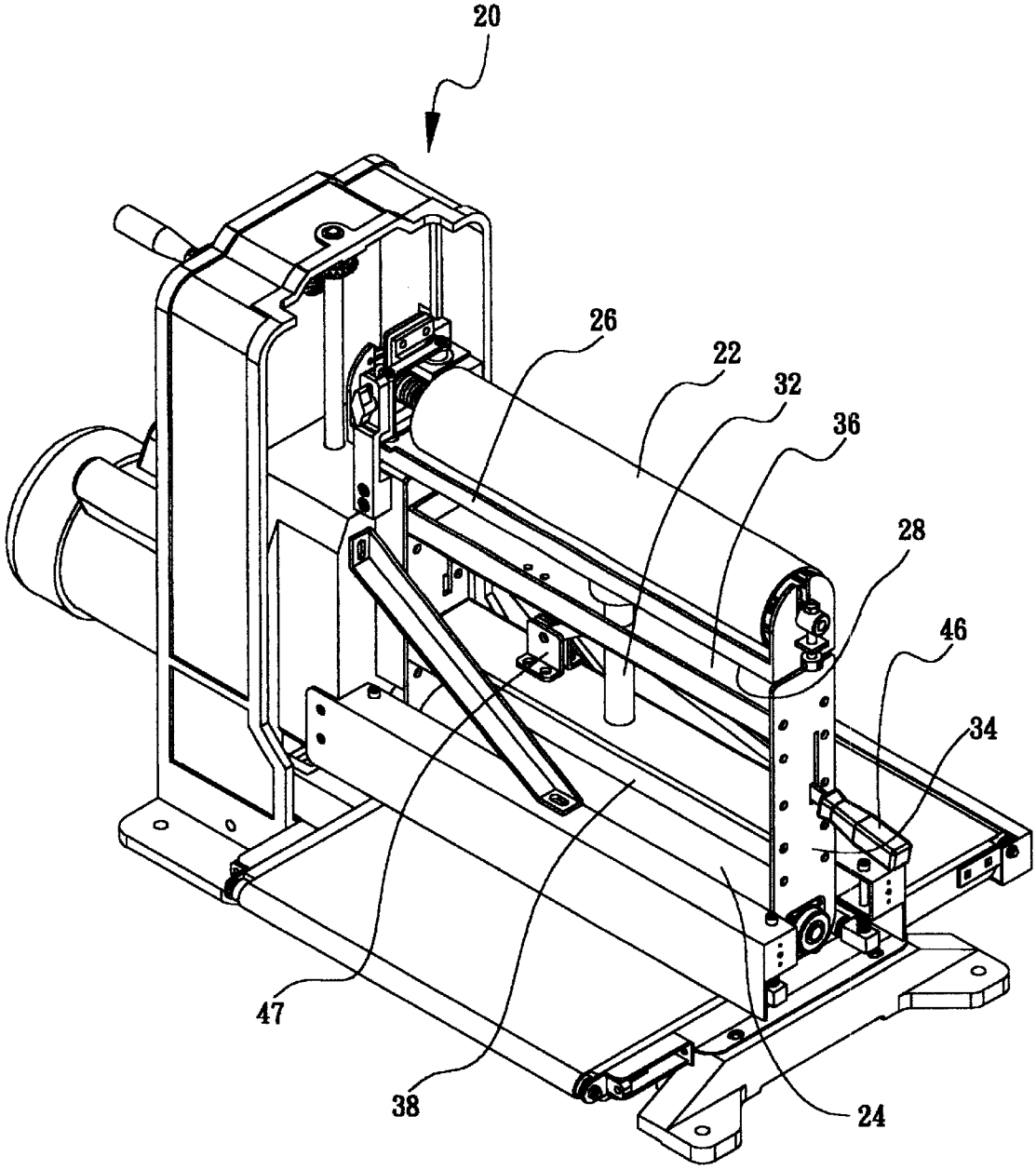
FIG. 3 is a partially perspective view of the sand-belt finishing machine having a sand-belt replacement mechanism in accordance with the preferred embodiment of the present invention.
Figure 4:
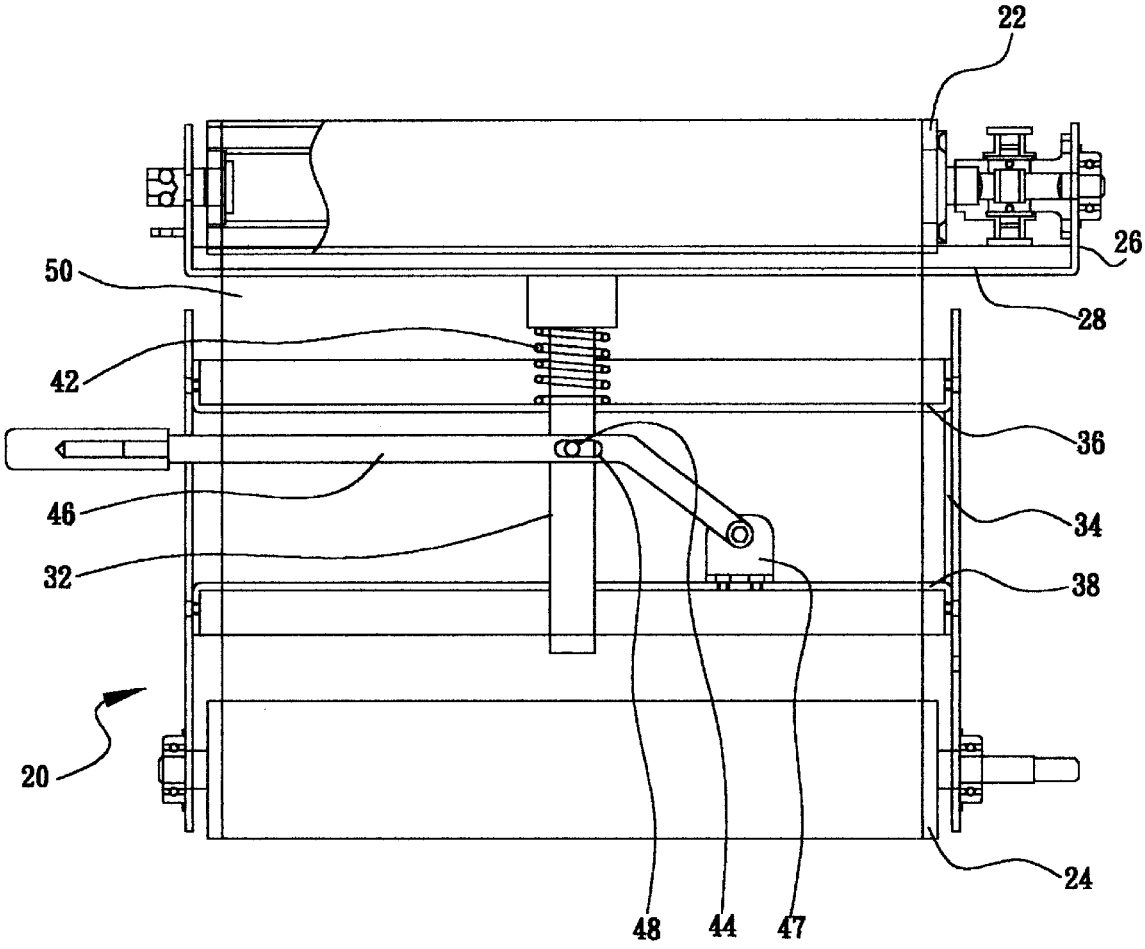
FIG. 4 is a schematic front plan view of the sand-belt finishing machine having a sand-belt replacement mechanism as shown in FIG. 3.

Referring to the drawings and initially to FIGS. 2–4, a sand-belt finishing machine having a sand-belt replacement mechanism in accordance with a preferred embodiment of the present invention comprises a main body 20, a first roller 22 mounted on the main body 20, and a second roller 24 mounted on the main body 20.

The first roller 22 and the second roller 24 are in parallel with each other. The first roller 22 is mounted on a support rack 26. An upright rod 32 is secured on a bottom face 28 of the support rack 26. The upright rod 32 is extended through an upper bracket 36 and a lower bracket 38 of a support frame 34. An elastic member 42 is mounted on the upright rod 32, and has a first end urged on the bottom face 28 of the support rack 26 and a second end urged on the upper bracket 36 of the support frame 34. A locking shaft 44 is mounted on a surface of the upright rod 32. A pivot base 47 is mounted on the lower bracket 38 of the support frame 34. A pull lever 46 is pivotally mounted on the main body 20, and has a first end pivotally mounted on the pivot base 47 and a second end extended outward from the main body 20. The pull lever 46 has a mediate portion formed with an elongated slot 48 to receive the locking shaft 44 of the upright rod 32, so that the locking shaft 44 of the upright rod 32 is slidably mounted in the elongated slot 48 of the pull lever 46. A sand belt 50 having a loop shape is mounted on the first roller 22 and the second roller 24.

During the normal use, the first roller 22 and the second roller 24 are rotated synchronously to drive the sand belt 50 to rotate. Thus, the wooden material (not shown) is passed through the lower side of the second roller 24, so that the wooden material is rubbed and finished by the sand belt 50, thereby achieving a finishing effect.

Figure 5:
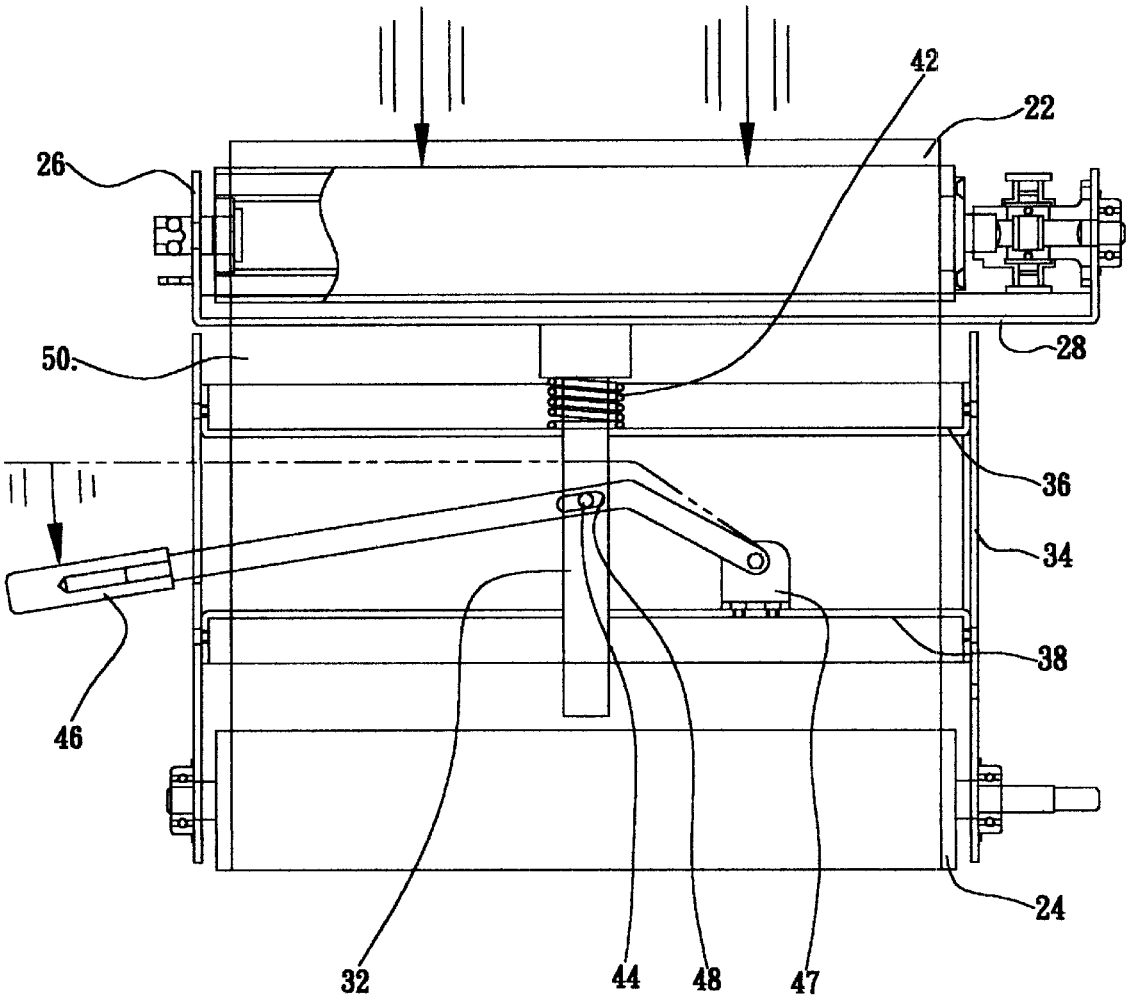
FIG. 5 is a schematic operational view of the sand-belt finishing machine having a sand-belt replacement mechanism as shown in FIG. 4 in replacement of the sand belt.

Referring to FIGS. 4 and 5 with reference to FIGS. 2 and 3, when the user needs to replace the sand belt 50, the pull lever 46 is pressed downward, so that the upright rod 32 is driven to move downward, and the bottom face 28 of the support rack 26 is driven to move downward to approach the upper bracket 36 of the support frame 34, thereby compressing the elastic member 42. At the same time, the pull lever 46 is locked on the main body 20.

In such a manner, the first roller 22 mounted on the support rack 26 is moved downward, so that the distance between the first roller 22 and the second roller 24 is shortened. Thus, the sand belt 50 can be removed from and mounted on the first roller 22 and the second roller 24 rapidly, easily and conveniently.

Then, after the pull lever 46 is released from the main body 20, the bottom face 28 of the support rack 26 is pushed to move upward and to move away from the upper bracket 36 of the support frame 34 by the restoring force of the elastic member 42, so that the first roller 22 mounted on the support rack 26 is returned to its original position, thereby increasing the distance between the first roller 22 and the second roller 24, so that the sand belt 50 is tightly and closely mounted and stretched on the first roller 22 and the second roller 24.

Accordingly, in the sand-belt finishing machine having a sand-belt replacement mechanism in accordance with the preferred embodiment of the present invention, the sand belt 50 can be mounted on and detached from the first roller 22 and the second roller 24 rapidly, easily and conveniently, thereby facilitating the user replacing the sand belt 50, saving the working time, and thereby facilitating maintenance of the sand-belt finishing machine.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A sand-belt finishing machine having a sand-belt replacement mechanism comprising:

a support rack;

a first roller mounted on the support rack;

a second roller located parallel with the first roller, and spaced from the first roller with a determined distance;

an upright rod secured on a bottom face of the support rack;

a locking shaft mounted on a surface of the upright rod;

an elastic member mounted on the upright rod;

a sand belt mounted on the first roller and the second roller; and a pull lever connected the upright rod to drive the upright rod to move and having a mediate portion formed with an elongated slot to receive the locking shaft of the upright rod, so that the locking shaft of the upright rod is slidably mounted in the elongated slot of the pull lever; wherein:

when the upright rod is moved by the pull lever to compress the elastic member, the distance between the first roller and the second roller is shortened; and when the upright rod is released by the pull lever, the upright rod is returned to its original position by the restoring force of the elastic member, so that the distance between the first roller and the second roller is increased.

2. The sand-belt finishing machine having a sand-belt replacement mechanism in accordance with claim 1, wherein the upright rod is extended through an upper bracket and a lower bracket of a support frame.

3. The sand-belt finishing machine having a sand-belt replacement mechanism in accordance with claim 2, wherein the elastic member has a first end urged on the bottom face of the support rack and a second end urged on the upper bracket of the support frame.

4. The sand-belt finishing machine having a sand-belt replacement mechanism in accordance with claim 2, further comprising a pivot base mounted on the lower bracket of the support frame, and the pull lever has one end pivotally mounted on the pivot base.

* * * * *